US005611536A

United States Patent [19]

Foreshew

[11] Patent Number: 5,611,536

[45] Date of Patent: Mar. 18, 1997

[54] PUZZLE BOX

[76] Inventor: David A. Foreshew, 306 Hwy 144 West, Chelmsford, Canada, P0M 1L0

[21] Appl. No.: 518,803

[22] Filed: Aug. 24, 1995

[51] Int. Cl.[6] ..... A63F 9/08

[52] U.S. Cl. ..... 273/153 S; 273/156

[58] Field of Search ..... 273/153 S, 156, 273/157 R, 160; 217/56, 59, 62; 109/58, 62; 312/330.1, 333, 348.4

[56] References Cited

U.S. PATENT DOCUMENTS

| | | | |
|---|---|---|---|
| 461,375 | 10/1891 | Spaunhorst | 312/330.1 |
| 498,299 | 5/1893 | Petway et al. | 312/330.1 |
| 673,083 | 4/1901 | Mato | 217/62 |
| 862,738 | 8/1907 | Howard | 217/62 |
| 2,532,083 | 11/1950 | Brenner | 217/62 |
| 3,216,558 | 11/1965 | Marsh | 273/153 S |
| 3,924,376 | 12/1975 | Tsurumi | 273/160 |
| 4,691,456 | 9/1987 | Ackeret | 40/10 |

FOREIGN PATENT DOCUMENTS

| | | | |
|---|---|---|---|
| WO83/00768 | 3/1983 | WIPO | G11B 23/02 |

*Primary Examiner*—Steven B. Wong
*Attorney, Agent, or Firm*—Thomas Adams

[57] ABSTRACT

A puzzle comprises a box formed by a sleeve and a drawer, similar to a matchbox, but with the sleeve closed at one end and open at the other end. The length of the drawer is equal to the interior length of the sleeve so that, when the drawer is inserted fully into the sleeve until its interior end abuts the closed end of the sleeve, the open end of the sleeve is closed by the outer end of the drawer, giving the appearance of a box with similar end panels. The edge of the sleeve at the open end has indents in at least two of its opposite faces. The drawer has corresponding protrusions which correspond exactly to the indents. When the drawer is fully inserted, the protrusions fill the indents and complete the respective surfaces. To open the box, the protrusions are grasped between finger and thumb and pulled outwards. Preferably, the box is shaped like a crate with longitudinal parallel slats simulating plank pieces and transverse slats simulating strapping. Each indent is formed by terminating one of the slats beneath the transverse slat. The corresponding protrusion is a slat portion equal to the missing section of the terminated slat. When the box is closed, the joint between the terminated slat and the slat portions is beneath the transverse slat, giving the impression that the slat portion is a continuation of the terminated slat.

12 Claims, 1 Drawing Sheet

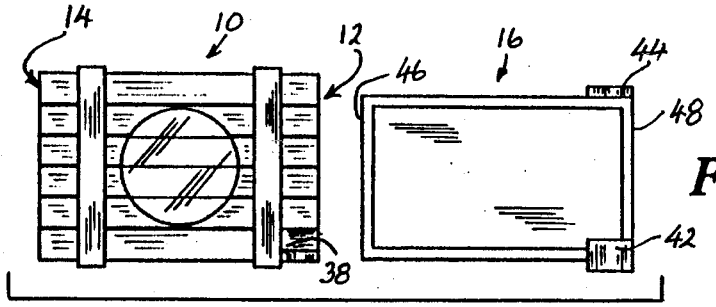
FIG. 1
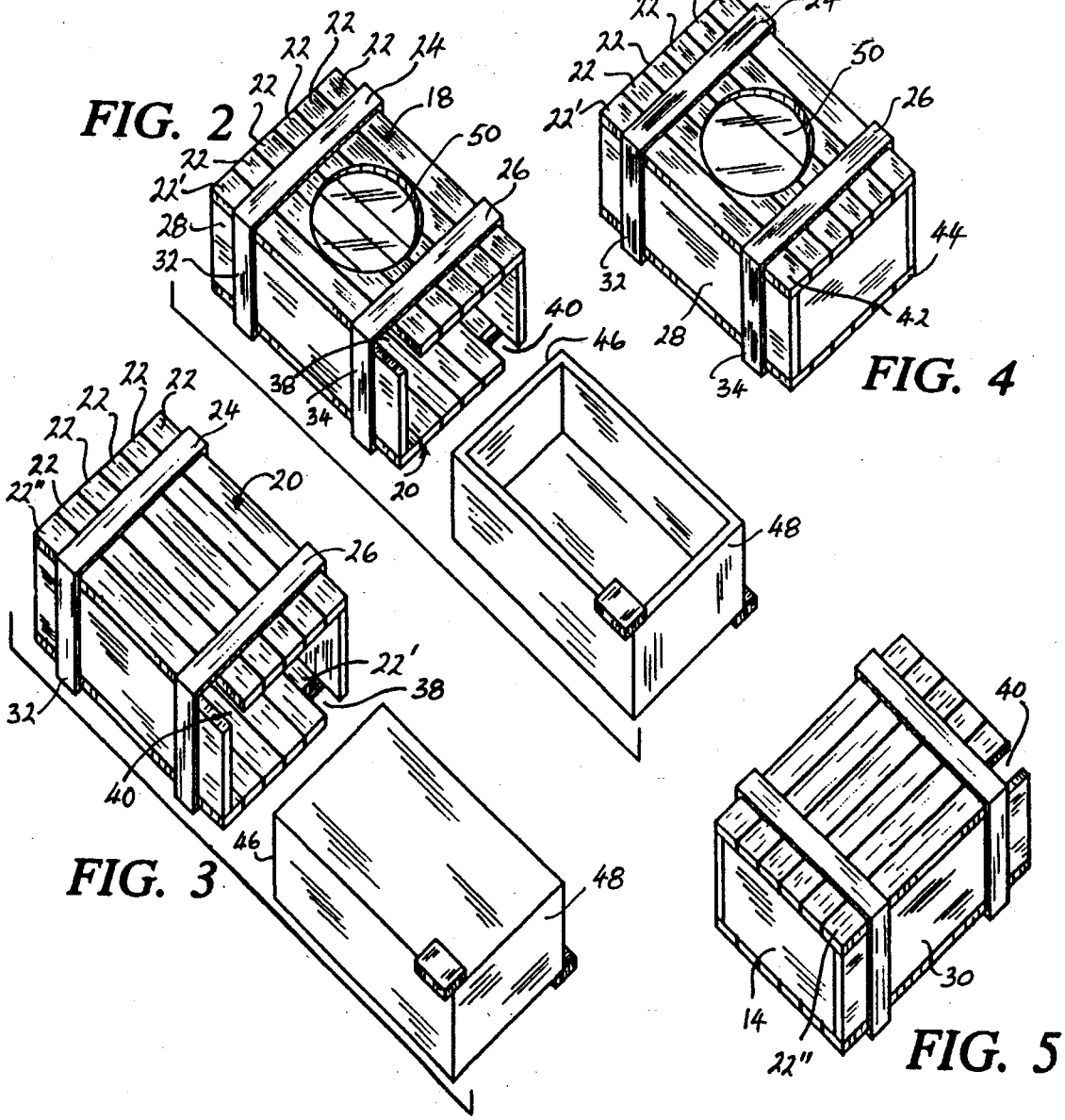
FIG. 2
FIG. 3
FIG. 4
FIG. 5

PUZZLE BOX

BACKGROUND OF THE INVENTION

1. Technical Field

This invention relates to puzzles.

2. Background Art

Many kinds of puzzles have been created to relieve boredom or provide amusement at social gatherings. These include interlocking pieces which must be separated, or dissected pieces of geometrical shapes which must be reassembled, closed containers which must be opened, and so on. The invention is especially concerned with puzzles requiring a certain amount of ingenuity or patience to gain access to a closed container.

SUMMARY OF THE INVENTION

According to the present invention, a puzzle box comprises an outer sleeve having a closed end and an open end and a drawer slidably housed within the sleeve, the drawer being retained within the sleeve by friction between respective parts of the drawer and the sleeve, the drawer having an interior end abutting the closed end of the sleeve and an exterior end closing off the open end of the sleeve. The sleeve has indents in its edge adjacent the open end and the drawer has complementary protrusions fitting into the indents and completing the sleeve, the arrangement being such that the protrusions appear to be parts of the sleeve. The complementary protrusions provide means whereby the drawer can be grasped and pulled to overcome the friction and withdraw the drawer from the sleeve.

The indents, and their complementary protrusions, may be provided at opposite sides of the puzzle box, allowing the protrusions to be grasped between a user's finger and thumb.

The outer sleeve may have at least three faces conjoined by corners, the indents being provided in at least two of the faces, each indent preferably adjacent one of the corners.

In one preferred embodiment, opposite faces of the outer sleeve comprise a plurality of parallel slats extending longitudinally and at least one slat extending transversely across the parallel slats and spaced inwardly from the open end of the sleeve, one of the parallel slats terminating beneath the transverse slat, each indent being formed by the opening between the end of the terminated slat and the open end of the sleeve. The protrusion comprises a slat portion equal in size to the indent, the arrangement being such that, when the drawer is inserted fully into the sleeve, the joint between the terminated slat and the slat portion is obscured by the transverse slat.

Preferably, the sleeve and the drawer are both parallelepiped with rectangular sides. The slats may be separate and bonded together to form sides of the sleeve. Alternatively, they may be defined by grooves in a sheet of material. Preferably, the outer sleeve and drawer are made of synthetic plastics material, the friction being provided by resilient engagement of the protrusions with the sleeve sides.

Various objects, features, aspects and advantages of the present invention will become more apparent from the following detailed description, taken in conjunction with the accompanying drawings, of a preferred embodiment of the invention.

BRIEF DESCRIPTION OF DRAWINGS

In the accompanying drawings;

FIG. 1 is a plan view from above of a puzzle box comprising an outer sleeve which is closed at one end and, shown separate, a drawer which fits within the outer sleeve;

FIG. 2 is a perspective view of the puzzle box from above and one end with the drawer removed from the outer sleeve;

FIG. 3 is a perspective view of the puzzle box from below and the one end with the drawer removed from the outer sleeve;

FIG. 4 is a perspective view of the puzzle box from above and the one end with the drawer within the outer sleeve; and FIG. 5 is a perspective view from below and the closed end of the outer sleeve alone.

DESCRIPTION OF THE PREFERRED EMBODIMENT

The closed puzzle box shown in the drawings is a hexahedron made of synthetic plastics material with rectangular faces and comprises an outer sleeve 10 which is open at one end 12 and closed at its opposite end by a flat panel 14 (FIG. 5). A drawer 16 is a close sliding fit in the sleeve 10.

The top 18 and bottom 20 of the outer sleeve 10 are formed by a set of six parallel slats 22 of plastics material which are fastened together by a pair of spaced, transverse slats 24 and 26 which extend transversely across slats 22. Each of the sides 28 and 30 of the outer sleeve 10 is a single, rectangular piece of plastics material with transverse slats 32 and 34 which are aligned with transverse slats 24 and 26, respectively. The puzzle box has the appearance of a wooden crate, the slats simulating planks.

The slat 22' adjacent one edge of the top of the sleeve 10, and the corresponding slat 22" at the diagonally-opposite edge of the bottom of the sleeve 10, do not extend the entire length of the sleeve 10. Instead, they terminate beneath the transverse slats 26 to leave indents 38 and 40 at respective opposite corners of the sleeve 10.

Short slat portions 42 and 44, respectively, are attached to the corresponding corners of the drawer 10. The slat portions 42 and 44 correspond in shape and size to the missing portions of the slats 22' and 22". When the drawer 16 is slid fully into the outer casing 10, the slat portions 42 and 44 fit closely into the notches 38 and 40, respectively. The joints between slat portions 42 and 44 and the corresponding shortened slats 22' and 22" are obscured by the transverse slat 26 so that the end slats 22' and 22" appear to be continuous, as shown in FIG. 4. The drawer 16 is shorter than the outer casing 10 by the thickness of the end wall 14 of the outer sleeve 10, so the interior end 46 of the drawer 16 abuts the end wall 14 when the drawer 16 is fully inserted. The outer face of the exterior end 48 of the drawer 16 resembles the exterior of closed end 14 of the sleeve 10. Hence, when the drawer 16 is fully housed in the sleeve 10, the exposed end 48 of the drawer 16 appears to be a closed end of the sleeve 10.

A round window 50 in the middle of the top of the sleeve 10 allows the interior of the box to be seen. The window 50 conveniently comprises a piece of transparent plastics material, such as perspex. It will appear as if the drawer 16 extends the entire length of the outer sleeve 10 and that the end plate 14 is actually the interior end 46 of the drawer 16.

As a general rule, when presented with the closed box and invited to open it, a person will assume that either the top or the bottom is hinged and opens like a lid. When that proves incorrect, the person may assume that the box has a sliding drawer, like a matchbox, and try pushing upon the ends of the box to slide the drawer 16 outwards. Pressing upon the exposed end 46 of the drawer 16, however, will simply press the interior end 46 of the drawer 16 harder against the closed end 14 of the outer sleeve 10. Conversely, pressing upon what appears to be the other end of the drawer 12, but is actually the closed end 14 of the outer sleeve 10, also will not move the drawer 16.

The friction fit between the drawer 16 and outer sleeve 10 is such that simply shaking or tapping the box will not cause the drawer 16 to slide outwards and the user will not dislodge the drawer accidentally while handling the puzzle box. The friction fit may be obtained by using a relatively soft plastics material and suitable dimensioning of the parts. In particular, the sides of the drawer 16 will be slightly less in depth than the sidewalls 28 and 30, to allow the drawer 16 to slide into the sleeve 10. Hence, bonding the protrusions 42 and 44 directly onto the sides of the drawer 16 will result in the protrusions 42 and 44 being spaced apart by slightly less than the corresponding depth of the stepped sidewalls 28 and 30 of the outer sleeve 10 so that the protrusions 42 and 44 grip the sidewalls 28 and 30, respectively, firmly and resiliently.

In order to open the puzzle box, the user grasps the outer sleeve 10 in one hand and grips the diagonally-opposite slat portions 42 and 44 between finger and thumb of the other hand. A firm tug to overcome the friction slides the drawer 16 outwards.

Although people exercise considerable ingenuity and patience as they try various alternative ways of opening the box, it does not usually occur to them to grasp the corner slat portions 42 and 44, because they appear to be parts of the slats 22' and 22". Hence, it would be illogical to try pulling them. The various futile attempts to open the box result in much amusement, especially for onlookers who know the secret.

It is preferable to use individual slats 22 bonded together since it enhances the impression that the corner pieces 42 and 44 are parts of the respective slats rather than attached to the drawer. For ease of manufacture, however, it might be preferable to mold the outer sleeve 10 as one piece, in which case deep grooves between the slats will enhance the impression that they are individual pieces.

It should be appreciated that, although a rectangular hexahedron is described herein, the principle could be applied to other shapes having corners, such as a triangular section prism.

Although an embodiment of the invention has been described and illustrated in detail, it is to be clearly understood that the same is by way of illustration and example only and is not to be taken by way of limitation, the spirit and scope of the present invention being limited only by the appended claims.

What is claimed is:

1. A puzzle box comprising an outer sleeve having a closed end and an open end and a drawer slidably housed within the sleeve, the drawer being retained within the sleeve by friction between respective parts of the drawer and the sleeve, the drawer having an interior end and an exterior end such that the drawer is fully inserted into the sleeve, the interior end abuts the closed end of the sleeve and the exterior end closes off said open end of the sleeve, the sleeve having indents in its edge adjacent said open end, the drawer having complementary protrusions fitting into the indents and completing said edge of the sleeve, and means obscuring a joint between each protrusion and the corresponding indent such that the protrusions appear to be parts of the sleeve, the complementary protrusions providing means whereby the drawer can be grasped and pulled to overcome the friction and withdraw the drawer from the sleeve.

2. A puzzle box comprising an outer sleeve having a closed end and an open end and a drawer slidably housed within the sleeve, the drawer being retained within the sleeve by friction between respective parts of the drawer and the sleeve, the drawer having an interior end and an exterior end such that, when the drawer is fully inserted into the sleeve, the interior end abuts the closed end of the sleeve and the exterior end closes off said open end of the sleeve, the sleeve having indents in its edge adjacent said open end, the drawer having complementary protrusions fitting into the indents and completing said edge of the sleeve, the arrangement being such that the protrusions appear to be parts of the sleeve, the complementary protrusions providing means whereby the drawer can be grasped and pulled to overcome the friction and withdraw the drawer from the sleeve, wherein opposite faces of the outer sleeve comprise a plurality of parallel slats and at least one slat extending transversely across an outer surface of the parallel slats and spaced inwardly from the open end of the sleeve, one of the parallel slats terminating short of the open end and with one end beneath the transverse slat, the indent being formed between said one end of said one of the parallel slats and the open end of the sleeve, the protrusion comprising a slat portion corresponding in size and shape to the indent, the arrangement being such that, when the drawer is inserted fully into the sleeve, a joint between said one end of the terminated slat and the slat portion is obscured by the transverse slat.

3. A puzzle box as claimed in claim 2, wherein the outer sleeve comprises flat walls conjoined by corners and the indents are provided at respective corners.

4. A puzzle box as claimed in claim 3, wherein the outer sleeve and the drawer are both parallelepiped with rectangular sides and the indents are provided in opposite walls of the sleeve and at diagonally opposite corners of the outer sleeve.

5. A puzzle box as claimed in claim 4, wherein the slat portions are spaced apart by such a distance that each slat portion bears resiliently against an edge of an adjacent sidewall of the sleeve to provide said friction.

6. A puzzle box as claimed in claim 5, wherein at least the slat portions are of synthetic plastics material.

7. A puzzle box as claimed in claim 2, wherein the protrusions grip the outer sleeve resiliently to provided said friction.

8. A puzzle box as claimed in claim 1, wherein the outer sleeve comprises flat walls conjoined by corners and the indents are provided at respective corners.

9. A puzzle box as claimed in claim 8, wherein the outer sleeve and the drawer are both parallelepiped with rectangular sides and the indents are provided in opposite walls of the sleeve and at diagonally opposite corners of the outer sleeve.

10. A puzzle box as claimed in claim 8, wherein the protrusions are spaced apart by such a distance that each protrusion bears resiliently against an edge of an adjacent sidewall of the sleeve to provide said friction.

11. A puzzle box as claimed in claim 10, wherein at least the protrusions are of synthetic plastics material.

12. A puzzle as claimed in claim 1, wherein the protrusions grip the outer sleeve resiliently to provide said friction.

* * * * *